US006397811B1

(12) United States Patent
Marsh et al.

(10) Patent No.: US 6,397,811 B1
(45) Date of Patent: Jun. 4, 2002

(54) ELECTRONICALLY CONTROLLED LUBRICATING OIL REMOVAL SYSTEM

(75) Inventors: Jerry L. Marsh, Seymour; Kevin C. Coleman, Trafalgar, both of IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 09/522,035

(22) Filed: Mar. 9, 2000

(51) Int. Cl.[7] ..... F02B 33/04
(52) U.S. Cl. ..... 123/196 R
(58) Field of Search ..... 123/196 S, 196 R, 123/196 A, 73 AD

(56) References Cited

U.S. PATENT DOCUMENTS

| | | | | |
|---|---|---|---|---|
| 1,186,485 A | | 6/1916 | McClelland | |
| 1,228,335 A | | 5/1917 | McClelland | |
| 2,042,744 A | | 6/1936 | Tear et al. | |
| 3,204,858 A | | 9/1965 | Dros | |
| 3,447,636 A | | 6/1969 | Bonfilio | |
| 4,342,543 A | | 8/1982 | Allen et al. | |
| 4,421,078 A | | 12/1983 | Hurner | |
| 4,495,909 A | | 1/1985 | Hurner | |
| 4,869,346 A | | 9/1989 | Nelson | |
| 5,390,762 A | | 2/1995 | Nelson | |
| 5,431,138 A | | 7/1995 | Hurner | |
| 5,476,073 A | | 12/1995 | Betts | |
| 5,676,106 A | | 10/1997 | Hoffman, II et al. | |
| 5,720,249 A | | 2/1998 | Betts et al. | |
| 5,749,339 A | | 5/1998 | Graham et al. | |
| 5,970,942 A | * | 10/1999 | Koeberlein et al. | 123/196 R |
| 6,213,080 B1 | * | 4/2001 | Marsh et al. | 123/196 R |

* cited by examiner

*Primary Examiner*—Marguerite McMahon
*Assistant Examiner*—Hyder Ali
(74) *Attorney, Agent, or Firm*—Nixon Peabody LLP; Charles M. Leedom, Jr.; Tim L. Brackett

(57) ABSTRACT

A novel method and system for automatically removing an engine's used lubricating oil and injecting the used oil into the engine's fuel system throughout operation is disclosed. The lube oil removal system includes a removal and injection pump including a spring biased piston forming a chamber on each side. The lube oil removal system also includes a transfer circuit connecting the chambers and a pump control device for controlling the flow between the chambers. The pump control device also controls the flow of used oil from the engine to one of the chambers while a discharge circuit connects the other chamber to the engine fuel system. In a first position, the pump control device blocks the used oil from the engine while connecting the chambers and, in a second position, connects the used oil circuit to one of the chambers while blocking flow between the chambers.

15 Claims, 1 Drawing Sheet

ELECTRONICALLY CONTROLLED LUBRICATING OIL REMOVAL SYSTEM

TECHNICAL FIELD

This invention relates to a removal system for removing an engine's used lubricating oil from the engine's lube oil system throughout engine operation.

BACKGROUND OF THE INVENTION

It is highly desirable to be able to minimize the amount of service required for internal combustion engines to thereby minimize the interruption in the use of the vehicle/equipment. Degradation and contamination of engine lubricating oil during engine use requires oil changing procedures which account for a significant portion of the maintenance and associated engine "down time". Conventional periodic oil changes generate an accumulation of waste lubricating oil which must be disposed of and/or processed resulting in undesirable costs. Therefore, extending oil drain intervals and reducing waste disposal are of great value to vehicle/equipment operators.

Consequently, systems have been developed for automatically changing internal combustion engine crankcase oil during engine operation. For example, U.S. Pat. No. 3,447,636 discloses a system for automatically changing engine oil while the engine is operating. The system operates to drain substantially all of the used oil from the engine immediately prior to introducing fresh oil into the engine from a reservoir. The single operation process results in a complete change of the substantially the entire engine oil volume. However, draining the engine prior to refilling with fresh oil necessarily creates a risk that an inadequate supply of lube oil exists in the engine for an interim time period possibly resulting in damage or excessive wear to engine components from insufficient lubrication. Moreover, this system undesirably results in a quantity of waste oil.

Other systems have been developed which automatically change engine lube oil during engine operation while avoiding a waste quantity of oil by directing the used lube oil into the fuel system for burning with the fuel in the engine. These systems periodically drain a small amount of the used oil from the engine lube oil system, and replace the drained quantity with fresh lubricant from an auxiliary tank. For example, U.S. Pat. Nos. 4,869,346 and 5,390,762 to Nelson disclose an automatic crankcase oil change and makeup system including a displacement unit having a piston with a predetermined stroke set to deliver identical, predetermined amounts of fresh oil during each stroke at the same flow rate and volume as the extraction of used oil. The pressure of the used lubricating oil is used to cause the periodic addition of the fresh oil to the crankcase. The frequency of the pressure strokes is set by a timer in an electronic controller, and is adjustably set to stroke at fixed time intervals to provide a cumulative quantity of fresh oil to the crankcase according to the regular recommended oil change period for the particular engine. A pair of dials on the controller enable the frequency of the pressure strokes to be adjusted. However, the piston and cylinder of the displacement unit necessarily receives both used oil and fresh oil. Therefore, the removal and make-up systems are integrated together thereby requiring a fresh oil system which may be undesirable in certain applications.

U.S. Pat. Nos. 4,421,078; 4,495,909; and to Hurner disclose similar systems for oil changing and making up during engine operation which include a control module having an adjustable impulse timer set to periodically cycle an air pressure operated oil extractor pump at a fixed time intervals to direct a predetermined amount of engine oil out of the oil pan and into the fuel tank. The pump includes a cylinder containing a movable piston defining opposed chambers and a solenoid valve operating to connect one chamber with lube oil and the opposite chamber with pressurized air such that used oil is delivered to the fuel system from only one chamber. Fresh makeup oil is pumped from an oil reservoir to the crankcase, also by air pressure, in response to a low level signal from a dipstick sensor. However, these systems require the use of pressurized air to actuate the oil changing/removing device. As a result, this system may be difficult and expensive to integrate into an engine.

Although capable of automatically changing lube oil during engine operation, the automatic oil changing systems discussed hereinabove are incapable of accurately varying and controlling oil changing in response to the actual needs of the engine that vary based on the engine operating conditions, such as fuel consumption. U.S. Pat. No. 5,7491,339 discloses an electronically controlled continuous lubricating oil replacement system which injects the used engine lubricating oil into the engine fuel system during operation based on engine operating conditions. An electronic controller is provided to vary the amount of used lube oil injected into the fuel system based on the severity of engine operation. The system maintains the quality of the engine lube oil at a level necessary to provide optimal engine protection at all engine operating conditions. This reference recognizes that the lube oil pumps disclosed in the Hurner references may be used in conjunction with the '339 system with the pressurized lube oil being used instead of pressurized air to force the used lube oil into the fuel system. However, neither the '339 nor the Hurner references disclose a simple, low cost system for accomplishing lube oil removal without automatic fresh oil replacement.

U.S. Pat. No. 5,676,106 discloses an oil renewal system including a single piston oil removal system without automatic fresh oil replacement including two chambers wherein used oil pressure in one chamber moves the piston to force used oil from the other chamber into a fuel system. However, oil is delivered from both chambers into the fuel system and each stroke of the piston results in oil delivery to the fuel system.

Therefore, there is a need for an engine lube oil removal system capable of effectively controlling the quantity of used lube oil removed from an engine lube oil system in a simple, inexpensive manner.

SUMMARY OF THE INVENTION

It is an object of the present invention, therefore, to overcome the disadvantages of the prior art and to provide a lube oil removal system for an engine capable of reliably, accurately and effectively controlling the rate at which lube oil is removed from the engine's lube oil system.

It is another object of the present invention to provide an oil removal system capable of burning only the optimal quantity of lube oil in the engine's fuel system.

It is yet another object of the present invention to provide an oil removal system which eliminates complete oil changes by avoiding oil draining and disposal so as to minimize engine down time.

Still another object of the present invention is to provide a low cost yet reliable oil removal system which allows the use of existing systems or procedures to be efficiently utilized in a cost effective manner to achieve fresh oil replacement.

Yet another object of the present invention is to provide an electronically controlled continuous oil removal system which eliminates the need to dispose of used engine oil.

Another object of the present invention is to provide an inexpensive electronically controlled continuous oil removal system which can be easily retrofit on existing engines and integrated into new engines.

Still another object of the present invention is to provide a lube oil pump system which includes a single piston and a minimum number of control valves thereby providing a compact, inexpensive and lightweight lube oil pump assembly.

These and other objects of the present invention are achieved by providing an electronically controllable lube oil removal system for an engine lube oil system comprising a removal and injection pump including a piston mounted for reciprocal movement, a first chamber positioned on one side of the piston and a second chamber mounted on a second side of the piston. The piston moves through a transfer stroke toward the first chamber and through an injection stroke toward the second chamber. A used oil circuit is provided and connected to the engine lube oil system. Also, a pump control device is provided for controlling a flow of used oil from the first chamber into the second chamber to cause movement of the piston through the transfer stroke and for controlling a flow of used oil from the engine lube oil system through the used oil circuit into the first chamber to cause movement of the piston through the injection stroke and discharge of the removed used oil from the second chamber. The removal and injection pump may include a biasing spring positioned to bias the piston toward the first chamber. A discharge circuit may be connected to the second chamber and a check valve positioned in the discharge circuit to prevent backflow into the second chamber. A transfer circuit may be used to connect the first chamber and the second chamber while a check valve may be positioned in the transfer circuit to prevent flow from the second chamber to the first chamber. The pump control means may include only one two-position, three-way valve and this valve may be solenoid operated.

The present invention is also directed to an engine comprising a lube oil system, a fuel system for supplying fuel to the engine land a removal and injection pump including a piston mounted for reciprocal movement. The removal and injection pump also includes a first chamber positioned on one side of the piston and a second chamber mounted on a second side of the piston wherein the piston is operable to move through the transfer and injection strokes. The used oil circuit and the transfer circuit mentioned above are also provided. A pump control valve device is also included which is positioned along the transfer circuit and the used oil circuit. The pump control valve device is movable into a first position blocking flow of used oil from the used oil circuit into the first chamber while permitting removed used oil flow from the first chamber to the second chamber and a second position blocking flow of used oil between the first and the second chambers while permitting flow of used oil from the used oil circuit into the first chamber causing movement of the piston through the injection stroke and discharge of used oil from the second chamber for injection into the fuel system.

The present invention is also directed to a method for removing used lube oil from an engine lube oil system, comprising the steps of providing a removal and injection pump including a piston mounted for reciprocal movement, a chamber positioned on one side of the piston and a second chamber mounted on a second side of the piston. The steps further include directing a flow of used oil from the engine lube oil system into the first chamber to form a removed quantity of used oil, directing at least a portion of the removed quantity of used oil from the first chamber into the second chamber and discharging the at least a portion of the removed quantity of used oil in the second chamber from the second chamber. Also, the step of directing a flow of used oil from the engine lube oil system into the first chamber to form a removed quantity of used oil may occur simultaneously with the step of discharging the at least a portion of the removed quantity of used oil in the second chamber from the second chamber.

DETAILED DESCRIPTION OF THE INVENTION

Figure 1:
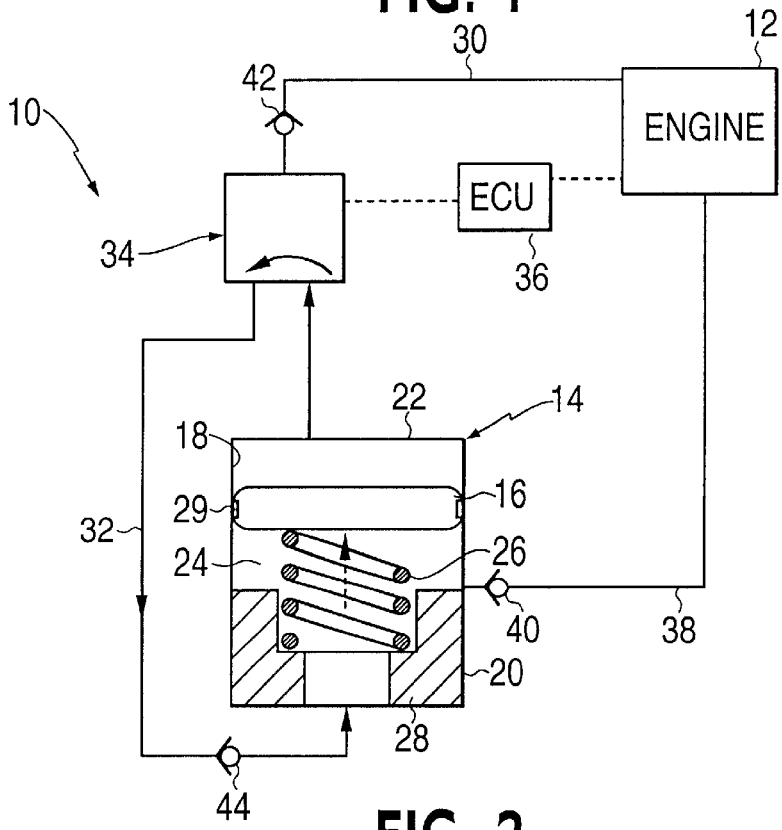
FIG. 1 is a diagrammatic view illustrating the electronically controllable lube oil removal system of the present invention as connected to an engine with the piston moving through a transfer stroke.
Figure 2:
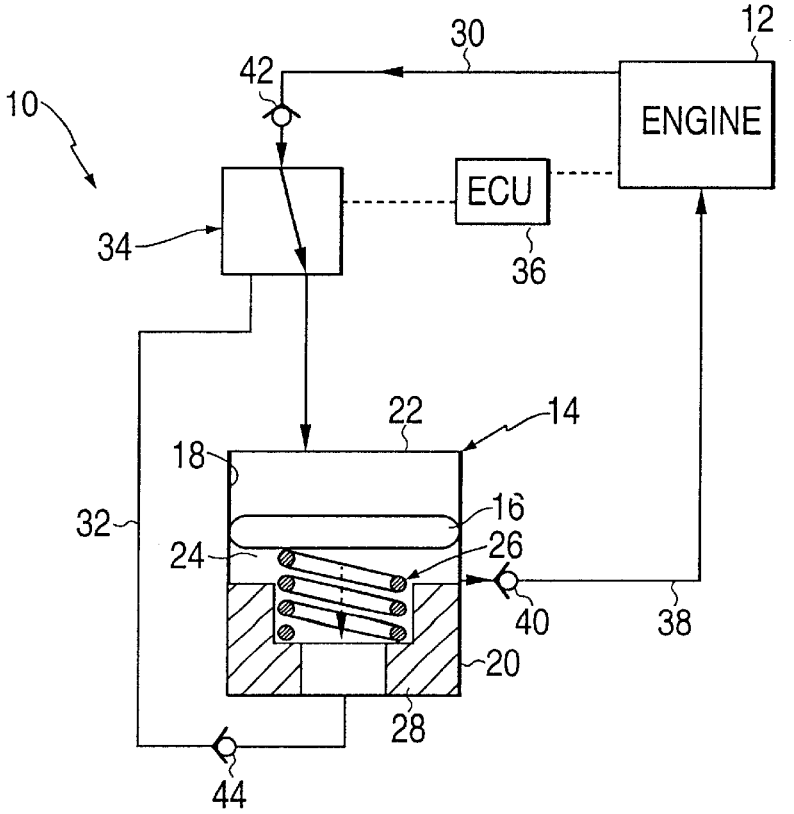
FIG. 2 is a view similar to FIG. 1, but with the piston of the removal and injection pump moving through an injection stroke.

Referring to FIGS. 1 and 2, there is shown the electronically controlled lube oil removal system of the present invention, indicated generally at 10 connected to an engine 12 for removing used lube oil from an engine lube oil system during operation of engine 12. Preferably, electronically controlled lube oil removal system 10 also injects the used lube oil into an engine fuel system, e.g. fuel supply tank and/or fuel flow passages, for mixing and burning with the fuel in the engine's combustion chamber. As a result, electronically controlled lube oil removal system 10 advantageously removes predetermined quantities of used oil from the engine lube oil system throughout operation of the engine to permit another system or process, e.g. manual maintenance or an automatic fresh oil makeup system, to deliver fresh make up oil to the engine in an efficient cost effective manner as desired.

Electronically controlled lube oil removal system 10 may be used with any type of engine or operating device having a lubricating oil circuit for lubricating the moving components of the engine or device. For example, lube oil removal system 10 is preferably used with an internal combustion engine, such as a multi-cylinder or rotary engine, including a fuel system for supplying fuel to a combustion chamber for combustion and power generation.

Electronically controlled lube oil removal system 10 includes a removal and injection pump 14 including a piston 16 mounted for reciprocal movement in a piston bore 18 formed in a pump housing 20. A first or removal chamber 22 is positioned in bore 18 adjacent one end of piston 16 while a second or injection chamber 24 is formed in bore 18 on an opposite side of piston 16 for receiving removed oil from first chamber 22. As discussed hereinbelow, piston 16 is mounted for movement through a transfer stroke toward the first chamber 22 as shown in FIG. 1 and an injection stroke toward second chamber 24 as shown in FIG. 2. Piston 16 is biased toward first chamber 22 by a biasing spring 26 positioned in second chamber 24. One end of biasing spring 26 is positioned against piston 16 while the opposite end of spring 26 is positioned against a spring seat 28. Piston 16 includes a seal 29 designed to permit sliding movement while creating a fluidic seal.

Electronically controlled lube oil removal system 10 further includes a used oil circuit 30 connected to the engine lube oil system for delivering used oil toward removal and injection pump 14, a transfer circuit 32 connected at one end to first chamber 22 and at an opposite end to second chamber 24 for permitting lube oil flow from first chamber 22 to second chamber 24 and a pump control device 34 positioned along transfer circuit 32 and connected to used oil circuit 30. Pump control device 34 functions to selectively move into a first position blocking flow of used oil from used oil circuit 30 into first chamber 22 while permitting removed used oil flow from first chamber 22 to second chamber 24 causing piston 16 to move through a transfer stroke and a second position blocking flow of used oil between first chamber 22 and second chamber 24 while permitting flow of used oil from used oil circuit 30 into first chamber 22 causing movement of piston 16 through an injection stroke as shown in FIG. 2. Although pump control device 34 may be any valve or combination of valves capable of controlling lube oil flow as described herein, pump control device 34 is preferably a single three-way, two-position type valve and preferably actuated by a solenoid assembly.

Pump control device 34 is operated by an electronic control unit (ECU) 36, or any other electronic unit or controller capable of controlling the operation of pump control device 34 based on a preset control scheme or variably controlling device 34 utilizing an algorithm. For example, electronically controlled lube oil removal system 10 could be used in conjunction with a preset yet possibly adjustable impulse timer system as disclosed in U.S. Pat. Nos. 4,421,078; 4,495,909; and 5,431,138. However, preferably electronically controlled lube oil removal system 10 is operated to vary the quantity of used lube oil removed from the engine 12 based on varying engine operating conditions by utilizing a control process and system such as disclosed in U.S. Pat. No. 5,749,339, the entire contents of which is hereby incorporated by reference.

Electronically controlled lube oil removal system 10 also includes a discharge circuit 38 connected at one end to second chamber 24 and at an opposite end to the engine fuel system. Of course, discharge circuit 38 may be connected to a different oil disposal system, such as a collection system. However, the advantage of the preferred embodiment in discharging the used oil to the fuel system is in reducing both the amount of waste oil for disposal and the time and cost during periodic engine maintenance checks. Discharge circuit 38 includes a check valve 40 for permitting flow from chamber 24 through discharge circuit 38 while preventing backflow from discharge circuit 38 into second chamber 24. In the present system, discharge circuit 38 may connect to the engine fuel system, such as a fuel supply tank, a fuel supply line to the engine and/or a fuel return line from the engine. It should be also noted that used oil circuit 30 includes a check valve 42 for permitting flow from used oil circuit 30 through pump control device, i.e. valve, 34 while preventing flow from transfer circuit 32 through pump control device 34 into used oil circuit 30. Likewise, transfer circuit 32 includes a check valve 44 positioned immediately upstream of second chamber 24 for permitting flow into second chamber 24 while preventing a backflow of lube oil from second chamber 24 thereby causing lube oil in second chamber 24 to flow through check valve 40 and discharge circuit 38 when piston 16 moves through the injection stroke as shown in FIG. 2.

During operation of engine 12, when it is automatically determined that a predetermined quantity of used lube oil should be removed from the engine's lube oil system, ECU 36 delivers an electronic signal to pump control valve device 34 causing pump control valve device 34 to move into the position shown in FIG. 1 blocking flow from used oil circuit 30 while connecting first chamber 22 and second chamber 24 via transfer circuit 32. As a result, biasing spring 26 moves piston 16 through a transfer stroke toward first chamber 22 causing removed used lube oil in first chamber 22 to flow through transfer circuit 32 into second chamber 24. The removed used oil in second chamber 24 lubricates seal 29 between piston 16 and housing 20. Pump control valve device 34 is then deactivated and moved into its second position blocking flow from first chamber 22 to second chamber 24 via transfer circuit 32 while connecting used oil circuit 30 to first chamber 22 via a portion of transfer circuit 32. As a result, pressurized used lube oil from the engine lube oil system flows through used oil circuit 30 and pump control valve device 34 into first chamber 22. The pressurized removed used oil in first chamber 22 creates pressure forces on piston 16 which overcome the biasing force of biasing spring 26 causing piston 16 to move through an injection stroke toward second chamber 24 as shown in FIG. 2. Consequently, since removed used lube oil in second chamber 24 is unable to flow through transfer circuit 32 due to check valve 44, the removed used oil in second chamber 24 flows outwardly through discharge circuit 38 and check valve 40 into the engine fuel system. The above-described cycle may then be repeated as necessary to deliver the desired quantity of removed used oil to the engine fuel system. It should be noted that at the completion of the injection stroke of piston 16, a full removed used quantity of lube oil is present in first chamber 22 and ready for delivery to second chamber 24 upon activation of pump control valve device 34.

Electronically controlled lube oil removal system 10 of the present invention is advantageous over conventional systems in a number of ways. First, the present lube oil removal system permits effective lube oil removal and injection into an engine fuel system while permitting an existing fresh oil makeup system or periodic maintenance checks to ensure adequate lube oil exists in the engine lube oil system. For example, in certain applications, a manual or automatic lube oil sump level detection system or procedure may be utilized to periodically check and maintain the level of the lube oil in the engine sump. For example, in many commercial applications, vehicles are subjected to frequent regular periodic preventive maintenance checks, for example, on a daily basis, during which the fluid level of various engine fluid systems are monitored by, for example, manually checking or perhaps replacing the lube oil. Therefore, many existing vehicles and maintenance procedures include existing auxiliary oil level maintenance systems such as daily preventive maintenance checks or an existing system for supplying fresh oil upon detecting a low oil sump level. The present system complements existing maintenance and fresh oil makeup systems in an efficient and cost effective manner. Secondly, the electronically controlled lube oil removal system 10 of the present invention utilizes a minimum number of components to further reduce complexity and cost. Third, the system of the present invention can be effectively utilized with various control schemes to optimize lube oil removal and injection as desired. Fourth, the lube oil removal system 10 of the present invention can be easily retrofit on existing engines with minimal time and expense and without major modifications.

INDUSTRIAL APPLICABILITY

The present lube oil removal system may be used in any internal combustion engine having a supply of lubricating fluid for lubricating the engine's components. However, the present system is particularly useful in any compression ignition engine of any vehicle, such as a truck or boat, or industrial equipment, such as construction or earth moving machines.

We claim:

1. An electronically controllable lube oil removal system for an engine lube oil system, comprising:

a removal and injection pump including a piston mounted for reciprocal movement, a first chamber positioned on one side of said piston and a second chamber mounted on a second side of said piston, said piston operable to move through a transfer stroke toward said first chamber and through an injection stroke toward said second chamber;

a used oil circuit connected to the engine lube oil system;

a pump control means for controlling a flow of used oil from said first chamber into said second chamber to cause movement of said piston through said transfer stroke and for controlling a flow of used oil from the engine lube oil system through said used oil circuit into said first chamber to cause movement of said piston through said injection stroke and discharge of the removed used oil from said second chamber, wherein said discharge circuit is connected to an engine fuel system to cause injection of the removed used oil discharged from said second chamber into the engine fuel system.

2. The lube oil removal system of claim 1, wherein said removal and injection pump further includes a biasing spring positioned to bias said piston toward said first chamber.

3. The lube oil removal system of claim 1, further including a discharge circuit connected to said second chamber and a check valve positioned in said discharge circuit to prevent backflow into said second chamber.

4. The lube oil removal system of claim 1, further including a transfer circuit connecting said first chamber and said second chamber and a check valve positioned in said transfer circuit to prevent flow from said second chamber to said first chamber.

5. The lube oil removal system of claim 1, wherein said pump control means includes only one two-position, three-way valve.

6. The lube oil removal system of claim 5, wherein said only one two-position, three-way valve is solenoid operated.

7. An engine, comprising:

a lube oil system;

a fuel system for supplying fuel to the engine;

a removal and injection pump including a piston mounted for reciprocal movement, a first chamber positioned on one side of said piston and a second chamber mounted on a second side of said piston, said piston operable to move through a transfer stroke toward said first chamber and through an injection stroke toward said second chamber;

a used oil circuit connected to the engine lube oil system for delivering used oil toward said removal and injection pump;

a transfer circuit connected at one end to said first chamber and at an opposite end to said second chamber to provide for used oil flow between said first and said second chambers;

a pump control valve device positioned along said transfer circuit and said used oil circuit, said pump control valve device movable into a first position blocking flow of used oil from said used oil circuit into said first chamber while permitting removed used oil flow from said first chamber to said second chamber and a second position blocking flow of used oil between said first and said second chambers while permitting flow of used oil from said used oil circuit into said first chamber causing movement of said piston through said injection stroke and discharge of used oil from said second chamber for injection into said fuel system.

8. The lube oil removal system of claim 7, wherein said removal and injection pump further includes a biasing spring positioned to bias said piston toward said first chamber.

9. The lube oil removal system of claim 7, further including a discharge circuit connected to said second chamber and a check valve positioned in said discharge circuit to prevent backflow into said second chamber.

10. The lube oil removal system of claim 7, further including a check valve positioned in said transfer circuit to prevent flow from said second chamber to said first chamber.

11. The lube oil removal system of claim 7, wherein said pump control valve device includes only one valve.

12. The lube oil removal system of claim 11, wherein said only one valve is a two-position three-way valve.

13. A method for removing used lube oil from an engine lube oil system, comprising the steps of:

providing a removal and injection pump including a piston mounted for reciprocal movement, a first chamber positioned on one side of said piston and a second chamber mounted on a second side of said piston;

directing a flow of used oil from the engine lube oil system into said first chamber to form a removed quantity of used oil;

directing at least a portion of said removed quantity of used oil from said first chamber into said second chamber; and discharging said at least a portion of said removed quantity of used oil in said second chamber from said second chamber into an engine fuel system.

14. The lube oil removal pump system of claim 13, wherein said step of directing a flow of used oil from the engine lube oil system into said first chamber to form a removed quantity of used oil occurs simultaneously with said step of discharging said at least a portion of said removed quantity of used oil in said second chamber from said second chamber.

15. An electronically controllable lube oil removal system for an engine lube oil system, comprising:

a removal and injection pump including a piston mounted for reciprocal movement, a first chamber positioned on one side of said piston and a second chamber mounted on a second side of said piston, said piston operable to move through a transfer stroke toward said first chamber and through an injection stroke toward said second chamber;

a used oil circuit connected to the engine lube oil system;

a pump control means for controlling a flow of used oil from said first chamber into said second chamber to cause movement of said piston through said transfer stroke and for controlling a flow of used oil from the engine lube oil system through said used oil circuit into said first chamber to cause movement of said piston through said injection stroke and discharge of the removed used oil from said second chamber; and a transfer circuit connecting said first chamber and said second chamber and a check valve positioned in said transfer circuit to prevent flow from said second chamber to said first chamber.

* * * * *